United States Patent [19]

Bien

[11] 3,931,653

[45] Jan. 13, 1976

[54] POWER OPERATED BACK REST

[76] Inventor: Jack M. Bien, 356 1/2 N. Ogden Drive, Los Angeles, Calif. 90036

[22] Filed: Sept. 30, 1974

[21] Appl. No.: 510,381

[52] U.S. Cl. ..... 5/327 B; 5/79
[51] Int. Cl.[2] ..... A47C 21/00; A61G 7/06
[58] Field of Search ..... 5/327, 70, 79

[56] References Cited

UNITED STATES PATENTS

| | | | |
|---|---|---|---|
| 1,336,197 | 4/1920 | Clampett | 5/70 |
| 2,666,216 | 1/1954 | Schnaitter | 5/327 R |
| 2,755,488 | 2/1956 | Fuhrer | 5/79 |
| 2,829,383 | 4/1958 | Creeger | 5/327 R |
| 3,606,623 | 9/1971 | Aymar | 5/327 B |

FOREIGN PATENTS OR APPLICATIONS

| | | | |
|---|---|---|---|
| 35,134 | 6/1922 | Norway | 5/77 |
| 858,371 | 1/1961 | United Kingdom | 5/327 B |

*Primary Examiner*—Philip C. Kannan
*Attorney, Agent, or Firm*—William P. Green

[57] ABSTRACT

A body rest apparatus having a base to be placed on a support surface and having a back rest actuable to different inclined positions relative to the base by a motor driven screw and nut mechanism located within the dihedral angle formed between the base and back rest elements.

7 Claims, 7 Drawing Figures

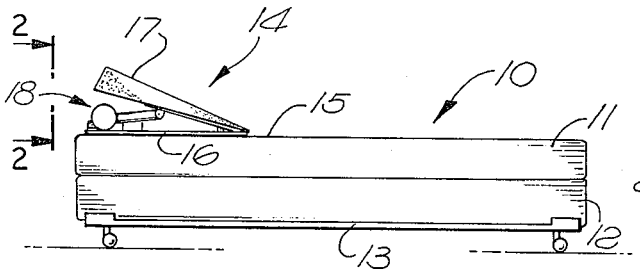
FIG. 1.
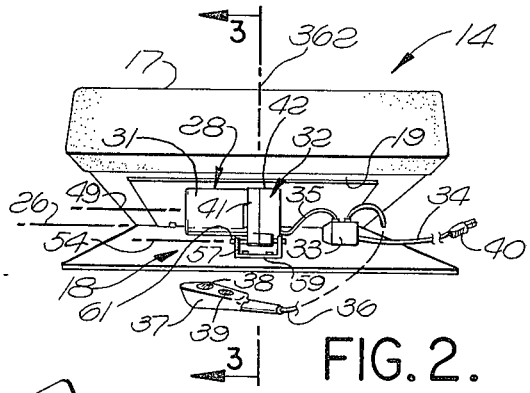
FIG. 2.
FIG. 4.
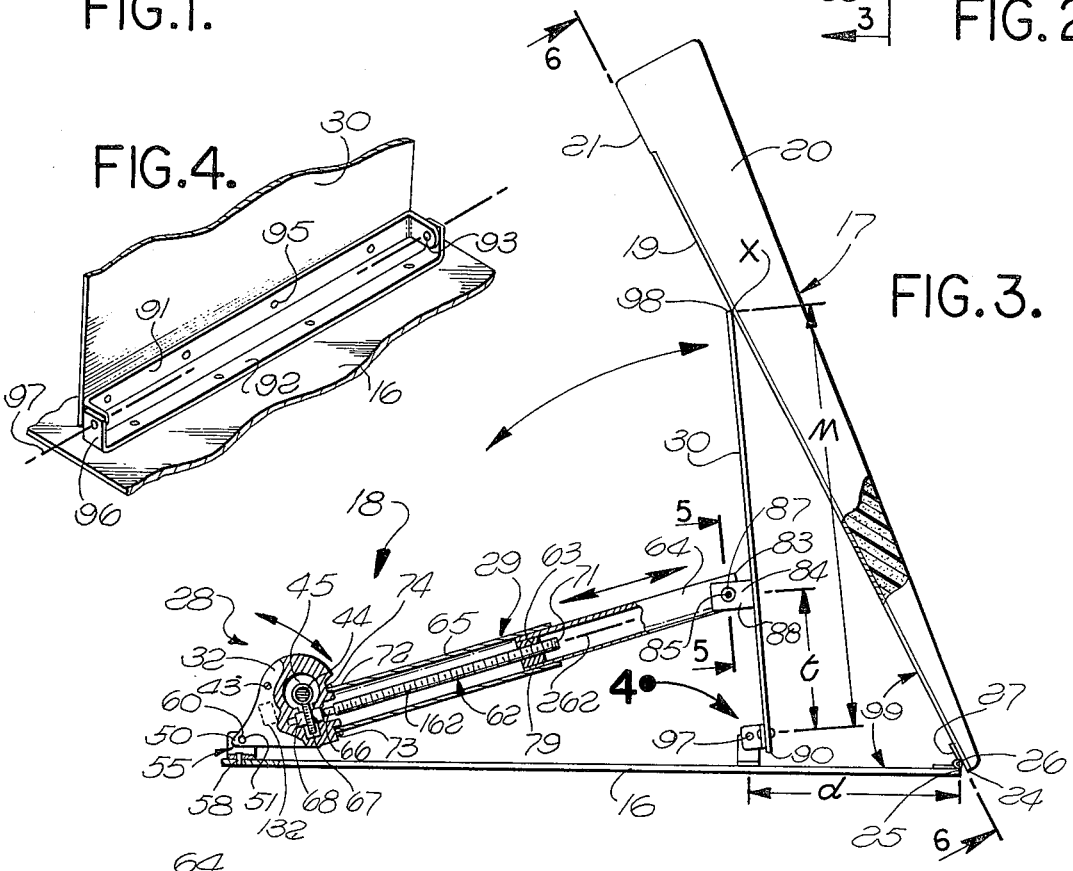
FIG. 3.
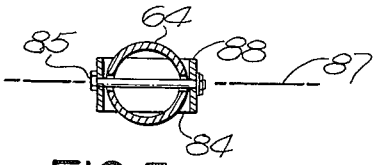
FIG. 5.
FIG. 6.
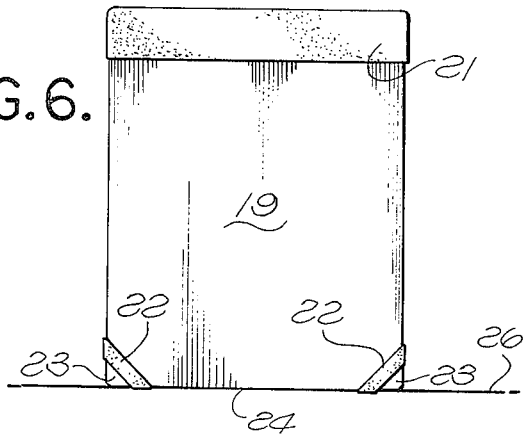
FIG. 7.
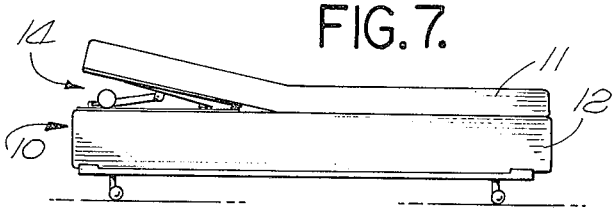

POWER OPERATED BACK REST

BACKGROUND OF THE INVENTION

This invention relates to improved power actuated back rest assemblies for supporting a person's back and head while in a reclining or semi-reclining position.

Power actuated back rests of various types have been utilized in the past in adjustable beds, such as for example those used in hospitals. One such adjustable bed is shown in Donaldson U.S. Pat. No. 2,988,758 which teaches the use of a relatively bulky and indirect dual motor arrangement for the purpose. The two motors are located at the foot of the bed and actuate the head portion of the bed upwardly and downwardly by two drive mechanisms extending from the motors along opposite sides of the bed. Another prior art adjustable bed, which is on the market but not shown in any particular patent of which I am aware, incorporates an electro-hydraulic power unit, in which a motor drives a fluid pump which in turn actuates an hydraulic piston and cylinder arrangement located behind the head portion of the bed. Necessary parts include a high pressure fluid pump, reservoir, lines, piston and cylinder mechanisms, seals, solenoid valves, and rectifiers for the valves.

These and other prior art adjustable bed structures of which I am aware have had at least two major drawbacks in use. In the first place, their structure has been unnecessarily complicated and therefore more costly than would be desired, both as to initial investment and as to cost of repair. Further, these prior mechanisms are not adapted for supporting a person's back in many of the non-hospital situations in which an adjustable back rest might otherwise be desirable, as for instance on a sofa, or on a conventional mattress, or other supporting surface which is not part of an adjustable bed but on which a person may wish to lie at a particular time. The incorporation of each of the previously proposed powered back rest arrangements into a certain bed structure limits its versatility and prevents use of the back rest except on that particular bed.

SUMMARY OF THE INVENTION

The general purpose of this invention is to provide an improved power actuated back rest which is less costly and more portable than the prior art devices and which can if desired be removably placed and used on virtually any supporting surface, such as for example a sofa or the like. The unit includes a base adapted to be placed on the support surface in generally horizontal condition, and a back rest hinged to the base for upward and downward swinging movement between differently inclined positions, together with a screw and nut actuating mechanism located within the dihedral angle formed between the hinged base and back rest elements. The screw and nut mechanism may be pivotally connected to the base, and preferably also to a swinging force transmitting member which is operatively interposed between the screw and nut mechanism and the back rest element. A rotary motor drives the screw and nut mechanism to actuate it between different conditions of extension, thereby actuating the back rest by way of the intermediate force transmitting member through different conditions of inclination relative to the base. When left in any given position, the friction and gearing of the actuating mechanism serve to brake the back rest against a force tending to change its position. Therefore no separate mechanism is needed to lock the back rest in that position.

The device can be constructed with its base and back rest elements both essentially planar in nature, preferably with the motor as well as the screw and nut actuation mechanism located within the discussed acute dihedral angle defined by these elements. This allows placement of the device on any flat surface, such as a bed, sofa or floor, or if desired allows insertion between the mattress and box spring of a conventional bed. The device may be frictionally retained wherever placed, and can be easily moved to different locations at different times by the user.

BRIEF DESCRIPTION OF THE DRAWINGS

The above and other features and objects of the invention will be better understood from the following detailed description of the typical embodiment illustrated in the accompanying drawing, in which:

FIG. 1 is a side elevational view of a portable body rest constructed in accordance with the invention, shown in a lowered condition in position on a bed;

FIG. 2 is an enlarged end perspective view of the body rest taken on line 2—2 of FIG. 1;

FIG. 3 is a further enlarged side view of the body rest in a raised condtion, partially broken away on line 3—3 of FIG. 2;

FIG. 4 is a perspective fragmentary view of the intermediate force transmitting member's hinge taken in the direction indicated by arrow 4 in FIG. 3;

FIG. 5 is an enlarged section through one pivoted connection taken on line 5—5 of FIG. 3;

FIG. 6 is a reduced view showing the back side of the hinged back rest element and taken on line 6—6 of FIG. 3; and FIG. 7 is a side elevational view similar to FIG. 1 but showing the back rest device as it appears when utilized between the mattress and box spring of a bed.

DESCRIPTION OF THE PREFERRED EMBODIMENTS

Referring first to FIG. 1, there is represented at 10 a conventional bed consisting of a mattress 11 and box spring 12 supported by a frame 13. Body rest assembly 14 is positioned on the upper horizontal surface 15 of mattress 11, and consists generally of base 16, back rest 17 and actuating mechanism 18.

FIGS. 2 and 3 show the structure of assembly 14 more clearly. Back rest element 17 may consist of an essentially planar rectangular rigid member 19 and an attached cushion 20, both of great enough length and width to accomodate the back, neck and head regions of an adult user in a reclining position. Cushion 20 may be removably attached to member 19 by a wide pocket 21 formed in the back of the cushion near its head region and two small elastic straps 22 also attached to its back and positioned diagonally across the two corners respectively at its lower end as shown in FIG. 6. Attachment of cushion 20 to member 19 is accomplished by slipping pocket 20 over the head end of member 19 and by stretching and frictionally securing each elastic strap 22 around its respective corner 23 at the foot end of member 19.

Member 19 is attached along its lower edge 24 to the corresponding edge 25 of base 16 for pivotal movement about an axis 26 which is parallel to and closely adjacent those two edges. The attachment is by simple hinges 27 riveted or otherwise secured to the underside of member 19 and the top of base 16 near axis 26, so that member 19 can swing freely about that axis relative to base 16. Base 16 supports actuating mechanism 18 and may be an essentially planar and essentially stiff and rigid member of dimension and composition similar to that of member 19.

Actuating mechanism 18 consists basically of a motor assembly 28, screw and nut mechanism 29, and a swinging force transmitting member 30. Motor assembly 28 may include a rotary electric motor 31 rigidly connected to and carrying a speed reduction gear housing 32. Motor 31 may be electrically connected to a source of power through a multiple conductor cord 35, a terminal box 33, and a second multiple conductor cord 34 carrying an electric plug 40 for insertion into a conventional power supply socket. Cords 34 and 35 are electrically connected to each other at their terminal box ends through a third cord 36 and a manually operated control unit 37, which may be held and be actuated by a person resting on the bed. The control unit 37 may have two push buttons 38 and 39 for energizing the motor to move the back rest upwardly and downwardly respectively. The circuit between cords 34 and 35 is normally open, when neither push button is depressed, so that in that condition no electric power is conducted to motor 31. Depression of either the "up" or "down" button of control 37, however, closes the circuit between the two cords 34 and 35 in one or the other condition of polarity, powering motor 31 to operate in its respective direction.

Terminal box 33 may also contain a starting capacitor connected across the power leads in a parallel electrical relation with motor 31, if necessary for the operation of the particular motor utilized. Also the gear housing 32 may contain a cam operated limit switch device, represented diagrammatically at 132 in FIG. 3, acting to automatically break the circuit to the motor in its extreme upper and lower positions to limit the range of powered movement of the back rest element 19.

Gear housing 32 may be composed of two parts 41 and 42, suitably connected to the output end of the motor by a number of screws 43, with the output shaft 44 of the motor projecting into the gear housing and turning about an axis 49 parallel to axis 26 of the back rest hinges 27. A worm 45 is carried by that shaft and rigidly affixed to and driven rotatively by it. The entire motor and connected reduction gear assembly is mounted to base 16 for relative pivotal movement about an axis 54 extending parallel to motor axis 31 and axis 26. For this purpose, the reduction gear housing 32 may have a hinge projection 50 through which a cylindrical opening 51 centered about axis 54 extends. A U-shaped hinge bracket 55 with aligned openings 56 in its parallel arms 57 is oriented along axis 54 and rigidly secured to base 16, as by rivets 58 extending through its center section 59. A hinge bolt or pin 60 projects through the registering openings 56 and 51 and is secured therein by a nut 61 to complete the pivotal mounting of the motor.

The screw and nut mechanism 29 includes an elongated screw 62 having an external thread 162 centered about an axis 262, a nut 63 which threadedly engages the screw and is rigidly and coaxially fixed within one end of a tube 64, and a sleeve 65 disposed about the screw. Screw 62 may have at its drive end a reduced diameter cylindrical shank 66 to which is affixed a worm gear 67 engaging and driven by worm 45 within gear housing 32. A pair of thrust bearings or bushings 68 carried by gear housing 32 journal shank 66 of screw 62 for rotation relative to the motor and reduction gear housings, about axis 262, and also retain the screw against axial movement.

Screw 62 projects from the motor assembly in a direction generally toward back rest element 17, with the axis 262 of the screw being disposed within, and swinging upwardly and downwardly within, a vertical central plane 362 (FIG. 2) which is perpendicular to hinge axis 54 and midway between the opposite sides of elements 16 and 19. Cylindrical sleeve 65 is positioned coaxially about screw 62, and extends therealong essentially from gear housing 32 to approximately the end 71 of the screw. One end 72 of sleeve 65 is secured rigidly to gear housing 32, as by reception within a shallow cylindrical recess 73 in housing 32, and retention therein by screws 74 extending through registering openings in housing 32 and sleeve 65 at that location.

The cylindrical tube 64, which may be roughly as long as and coaxial with sleeve 65, has an outside diameter slightly less than the inside diameter of sleeve 65, and is telescopically received therein. The nut 63 is rigidly carried within one end 79 of tube 64, to move that tube axially relative to the screw in response to rotary actuation of the screw. Such actuation is accomplished through worm 45 and worm gear 67 by motor 31.

Back Rest element 17 is actuated upwardly and downwardly about its axis 26 by the screw and nut mechanism 29, and particularly its tube 64, preferably through the action of an intermediate swinging actuating plate or lever member 30. Member 30 may be an essentially planar rectangular element slightly narrower than member 19, and approximately one half as tall. Its bottom edge 90 is attached to base 16 for pivotal movement about an axis 97 which extends parallel to axis 26 and closely proximate base 16 but is offset toward motor 31 from axis 26 by the distance *d* of FIG. 3. This offset distance *d* may be between about 1/5 and 1/3 (preferably about 1/4) of the total distance between axes 26 and 54. The pivotal connection between elements 30 and 16 may be formed by a pair of elongated U-shaped hinge brackets 91 and 92 secured to elements 30 and 16 respectively by rivets or other fasteners 95, and interconnected for pivotal relative movement by pivot pins or rivets 93 extending through vertical terminal ears 96 of the brackets.

The end 83 of tube 64 is pivotally attached to member 30 at a point spaced a substantial distance *t* from axis 97, preferably a distance equal to between about one-fourth and one-half of the total length *m* of member 30. A U-shaped hinge bracket 84 may be attached to member 30 for this purpose, with two parallel vertical arms 88 of the bracket received at opposite sides of tube 64 and connected to it by a pivot pin 85, for relative pivotal movement about a horizontal axis 87 extending parallel to axes 26, 54 and 97.

In operation, motor 31 is actuated in the desired direction of rotation by depression of either the up or down button on control 37, thus closing the power circuit in one or the other condition of polarity. The powered rotation of the rotor and driven shaft 44 of motor 31 about axis 49 acts through the reduction gearing consisting of worm 45 and worm gear 67 to turn lead screw 62 about its axis 262 in a corresponding direction. The rotation of screw 62 in turn causes nut 80 and the attached tube 64 to be actuated axially relative to the screw. Member 30, connected pivotally to end 83 of tube 64, swings about axis 97 at its base in response to this axial movement of tube 64. As it does so, the height of the end portion 83 of tube 64 above the plane of base 16 varies, and the entire motor and screw and nut assembly pivots about axis 54 accordingly.

As member 30 swings upwardly or downwardly about axis 97, the engagement of its upper horizontal edge 98 with the rear planar surface of back rest element 17 causes actuation of that element about its axis 26 between differently inclined positions. Mechanism 18 may be designed to actuate element 17 only through acute angles 99 with respect to the base, so that element 17 can never reach a position in which it might have a tendency to fall forward away from mechanism 18.

As a result, gravity always tends to hold element 17 against edge 98 of member 30. As the elements 17 and 30 change angular positions, the upper edge 98 of element 30 shifts slidably a short distance upwardly or downwardly relative to the engaged portion of element 17, by virtue of the offset relationship of the two pivotal axes 26 and 97 of these parts, but with effective transmission of supporting force between the parts in all positions. Because of the relative positioning of the two axes 26 and 97, the rate of angular movement of element 17 about its axis is less than the rate of angular movement of element 30 about its axis, to supplement the reduction gear effect of worm 45 and worm gear 67, as well as the screw and nut. To obtain this result, it is desirable that the distance between the point of interengagement of elements 19 and 30 (point $x$ in FIG. 3) and axis 26 be greater than the distance between point $x$ and axis 97.

The net effect of the parameters chosen for the worm and worm gear, the screw and nut, and the swinging member 30 is that many revolutions of motor 31 correspond to a relatively small angular movement of element 17. The motor is thus required to perform less work per revolution against a given external force than if a higher gearing were used, so that a less powerful motor is sufficient to overcome that force. Such a motor can be less expensive, smaller, lighter and more portable than would otherwise be the case. Also, accurate adjustment of the position of element 17 is facilitated by this low gearing since the speed of its movement is relatively low, allowing the user to easily stop the back rest at a desired position.

An additional advantage of the illustrated actuating mechanism resides in its capacity to effectively brake element 17 against a force tending to lessen the dihedral angle 99 between elements 19 and 30 in the unenergized state of the motor. The same gearing which is low with regard to actuation by motor 31 is high with regard to actuation by back rest element 17. The combined inertia and static friction of the moving parts, including especially the worm and worm gear and the screw and nut, are sufficient in this unenergized condition to brake the mechanism against such a force in normal use. Thus, even though a user leans all of his weight back against element 19, the inertia and friction of the moving parts hold element 19 in any set position and against movement to positions of decreasing angularity unless and until the motor is purposely energized.

FIG. 7 illustrates the use of the above-described body rest assembly 14 between the mattress 11 and box spring 12 of a conventional bed 10. By use in this way, the advantages of a power actuated adjustable bed can be attained at a cost much lower than that of other units for this purpose currently on the market. The device can be moved very easily from one bed to another, and can be held in position between the mattress and box springs by friction without the necessity for any type of connection to the bed. Cushion 20 may be removed from back rest element 19 in this use, to allow more complete retraction of the mattress in its lowermost position.

It is contemplated also that assembly 14 may be permanently built into a mattress as an integral part thereof if desired. Such a mattress would then have essentially the same appearance as the arrangement of FIG. 7, but with element 19 being permanently attached to the underside of the mattress for actuation thereof.

While certain specific embodiments of the present invention have been disclosed as typical, the invention is of course not limited to these particular forms, but rather is applicable broadly to all such variations as fall within the scope of the appended claims.

I claim:

1. An adjustable body rest assembly comprising:

a base adapted to be placed on and be supported by an upwardly facing surface of a bed or other support structure with said base in generally horizontally extending condition;

a back rest hinged to said base for pivotal movement about a first essentially horizontal axis through different inclined positions and forming a variable acute dihedral angle with said base;

an extensible screw and nut mechanism located above said base and within said dihedral angle and including a screw part and a threaded interengaged nut part one of which is actuable along a second axis relative to the other to lengthen said mechanism in response to relative rotation of the parts about said second axis;

said two parts exerting force in generally opposite directions against said base and said back rest at locations offset from said first axis to swing said back rest between said different inclined positions;

a rotary motor located above said base and within said dihedral angle and connected to said screw and nut mechanism and operable to drive one of said screw and nut parts rotatively relative to the other in a relation actuating said back rest between said different inclined positions;

a first pivotal connection attaching both said motor and said screw and nut mechanism at one end of the latter to said base for upward and downward swinging movement of both the motor and the screw and nut mechanism in unison within essentially a vertical plane disposed essentially transversely of said first axis and during actuation of said back rest about said first axis; and a second pivotal connection at the other end of said extensible screw and nut mechanism through which force is transmitted from said mechanism to the back rest to actuate it.

2. An adjustable body rest assembly as recited in claim 1, in which said base is essentially planar and has an essentially planar undersurface adapted to removably engage and be supported by said upwardly facing surface of the bed or other support structure.

3. An adjustable body rest assembly as recited in claim 1, including a swinging force transmitting part hinged to said base for relative swinging movement about a third axis generally parallel to but offset from said first axis and connected to said other end of the screw and nut mechanism by said second pivotal connection and acting to transmit actuating force from said screw and nut mechanism to said back rest.

4. An adjustable body rest assembly as recited in claim 3, in which said force transmitting part has sliding engagement with said back rest and shifts slidably relative thereto upon change in inclination.

5. An adjustable body rest assembly as recited in claim 1, in which said screw and nut parts and said rotary motor are so geared relative to each other and to said back rest that the combined inertia and static friction of the assembly in any particular setting thereof effectively brakes said back rest against a force tending to lessen its inclination.

6. An adjustable body rest assembly as recited in claim 1, in which said screw and nut mechanism includes tubes disposed about said screw and nut parts respectively.

7. An adjustable body rest assembly as recited in claim 1, in which said base is essentially flat and lies essentially within a predetermined plane, said assembly including an essentially flat force transmitting member mounted to said base for relative pivotal movement about a third axis essentially parallel to said first axis and acting to transmit force from said screw and nut mechanism to said back rest and having an upper edge slidably engaging the back rest, said first and third axes both lying in approximately the plane of said base, a speed reduction gear driving said screw part rotatively from said motor and mounted to swing upwardly and downwardly therewith, a first tube connected to said motor and disposed about said screw part, a second tube carrying said nut part and telescopically interfitting with said first tube and attached by said second pivotal connection to said swinging force transmitting member, and a cushion carried at a forward side of said back rest, said reduction gear and tubes and force transmitting member, in addition to said motor and said screw and nut parts, all being located within said dihedral angle between the base and back rest.

* * * * *